United States Patent [19]

Sekiya

[11] Patent Number: 4,746,915

[45] Date of Patent: May 24, 1988

[54] DRIVE CIRCUIT FOR MATRIX DISPLAY DEVICE

[75] Inventor: Fukuo Sekiya, Tokorozawa, Japan

[73] Assignee: Citizen Watch Company Limited, Tokyo, Japan

[21] Appl. No.: 935,104

[22] Filed: Nov. 24, 1986

Related U.S. Application Data

[63] Continuation of Ser. No. 573,087, Jan. 23, 1984, abandoned.

[30] Foreign Application Priority Data

Jan. 21, 1983 [JP] Japan ..... 58-008524

[51] Int. Cl.[4] ..... G09G 3/36

[52] U.S. Cl. ..... 340/719; 340/784; 340/801; 340/802; 377/129; 377/76; 377/115

[58] Field of Search ..... 340/784, 802, 801, 805, 340/718, 719; 377/56, 64, 65, 73, 75, 106, 115, 116, 76, 129; 307/289–292, 590, 593

[56] References Cited

U.S. PATENT DOCUMENTS 3,577,086 5/1971 Kliman ..... 377/76
3,912,950 10/1975 Tada ..... 377/115
4,542,301 9/1985 Narabu ..... 377/76
4,612,659 9/1986 Starke ..... 377/129

OTHER PUBLICATIONS

*CMOS Cookbook,* Lancaster; Howard W. Sams; 1977, pp. 266–269.

*Primary Examiner*—Marshall M. Curtis
*Attorney, Agent, or Firm*—Jordan and Hamburg

[57] ABSTRACT

A drive circuit for sequentially driving electrodes of a matrix display device such as a liquid crystal display panel comprises a shift register divided into a plurality of groups of shift register stages and means for selectively applying a first clock signal and a second signal to the groups of stages, so that the groups become successively operative and so that power consumption of the currently inoperative groups is minimized. The second signal can comprise a low-frequency refresh clock signal, in the case of a dynamic type of shift register, or a DC potential in the case of static-type shift registers. During changeover between adjacent groups of shift register stages, the first clock signal is applied simultaneously to both groups, in order to ensure stable operation.

3 Claims, 10 Drawing Sheets

DRIVE CIRCUIT FOR MATRIX DISPLAY DEVICE

This application is a continuation of application Ser. No. 573,087, filed Jan. 23, 1984, now abandoned.

BACKGROUND OF THE INVENTION

The present invention relates to a matrix display device for displaying images such as television images etc, and in particular to method of reducing the power consumption of a drive circuit used for driving the electrodes of an active matrix type of display panel such as a liquid crystal display panel, which comprises an active element provided for each of the picture elements.

There is at present an urgent requirement for planar types of display device, such as liquid crystal matrix type display panels, which can be utilized to display images such as television pictures etc in a similar manner to conventional types of CRT displays, but with greater compactness and lower power consumption. In order to minimize the overall size of such a matrix display device and reduce manufacturing costs, it is customary to provide at least a part of the drive circuits which drive the row and column electrodes of the display matrix, in integrated circuit form, directly upon one of the display panel plates or substrates. However in such a case, if any part of the drive circuits should be defective after manufacture, then the entire display device will be defective. Hence, in order to maximize the manufacturing yield of such a display device, it is desirable to make the drive circuits as simple and reliable as possible. Since such drive circuits are generally basically composed of a number of series-connectes shift-register stages, and since dynamic shift registers employ the minimum number of elements in their circuit configuration, it is highly desirable to use dynamic shift registers to form the electrode drive circuits of such matrix display devices.

In addition, in order to fully exploit the advantage of very low power consumption attainable by a liquid crystal display, it is desirable to minimize the overall power consumption of such circuits as far as possible. However in the case of a matrix display device used to display television images, with each row of display elements corresponding to a horizontal scanning line of a CRT display, the column electrodes of the matrix must be successively driven (i.e. selected for transfer of video signal data thereon) at a very high frequency, of the order of 4 MHz. Thus, due to the very large number of column electrodes, a considerable amount of power will be consumed in charging and discharging the input capacitances of the shift register stages constituting the column electrode drive circuit, using prior art types of drive circuit.

The present invention is directed towards overcoming the problems described above.

SUMMARY OF THE INVENTION

It is an objective of the present invention to overcome the problems described above, to achieve a reduction in the power consumption of an electrode drive circuit of a matrix display device such as a liquid crystal display panel, e.g. a column electrode drive circuit, and to achieve stable operation of such a drive circuit, and further to provide the capability for utilizing dynamic shift registers to form such an electrode drive circuit.

In order to achieve the above objectives with the present invention, the electrode drive circuit is formed as a shift register which is divided into a plurality of groups of shift register stages. Control circuit means act to selectively apply a first clock signal (i.e. a relatively high-frequency clock signal) and a second signal (i.e. a relatively low-frequency clock signal used for refresh purposes, if the shift register is of dynamic type, or a fixed DC potential if the shift register is of static type) to the groups of shift register stages by means of control signals arranged such that when selection is changed from one group to a succeeding group of shift register stages the first clock signal is applied simultaneously to these two groups during a predetermined time interval, thereby ensuring stable transfer of data between the various groups of shift register stages. In this way, power consumption is minimized in shift register groups which are not currently being supplied with the first clock signal, and in addition, since the second signal can comprise a low-frequency refresh clock signal, the use of dynamic shift registers is enabled.

DESCRIPTION OF THE PREFERRED EMBODIMENTS

Figure 1:
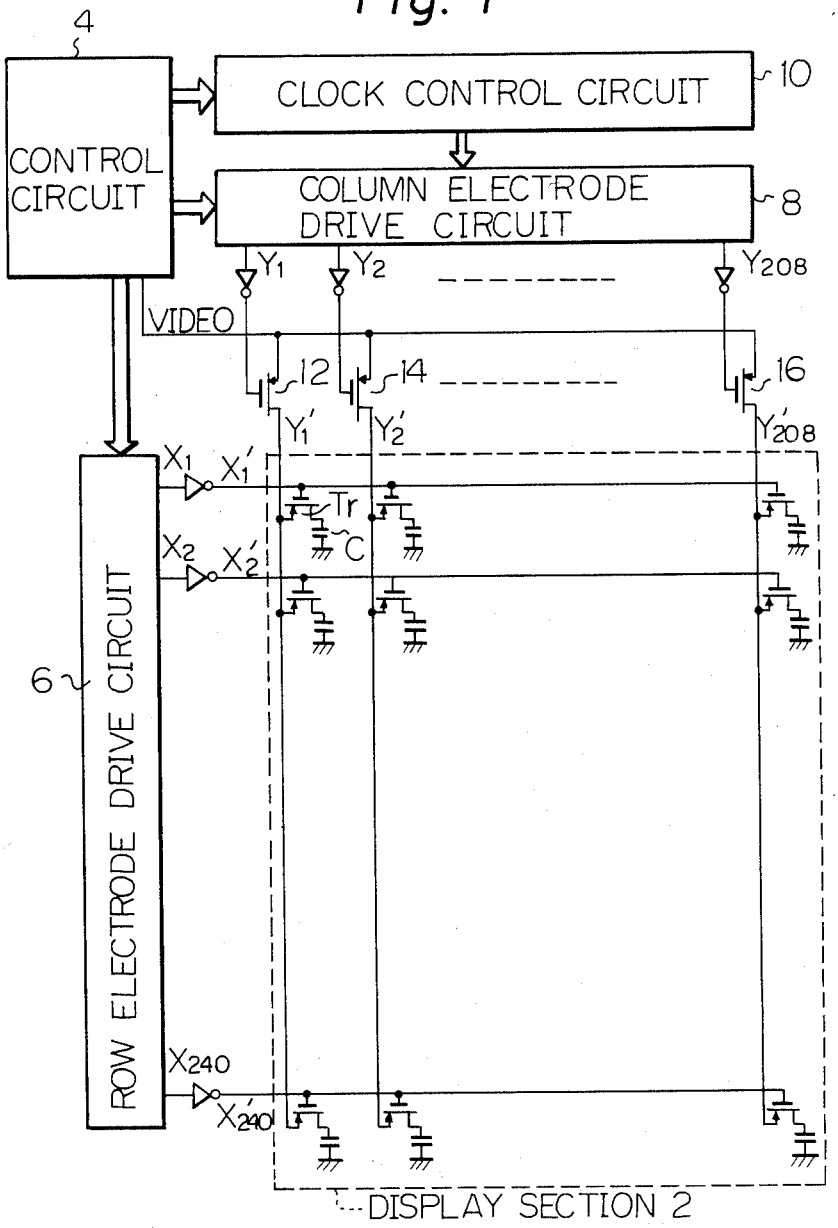
FIG. 1 is a block circuit diagram of a matrix display device to which the present invention is applicable.

The present invention will now be described in detail with reference to the drawings. FIG. 1 is a general circuit diagram of a liquid crystal matrix display panel having a 208×240 element configuration and the drive circuits associated therewith, to which the present invention is applicable. In FIG. 1, a transistor TR is provided at each intersection of column electrodes Y'1,Y'2, . . . ,Y'208 and row electrodes X'1,X'2, . . . ,X'240. The gate electrode of each of transistors TR is connected to a row electrode, one channel electrode thereof is connected to a column electrode, and the other channel electrode is connected to ground through a capacitor C.

The portion 2 shown surrounded by a broken line constitutes a display section.

Figure 2:
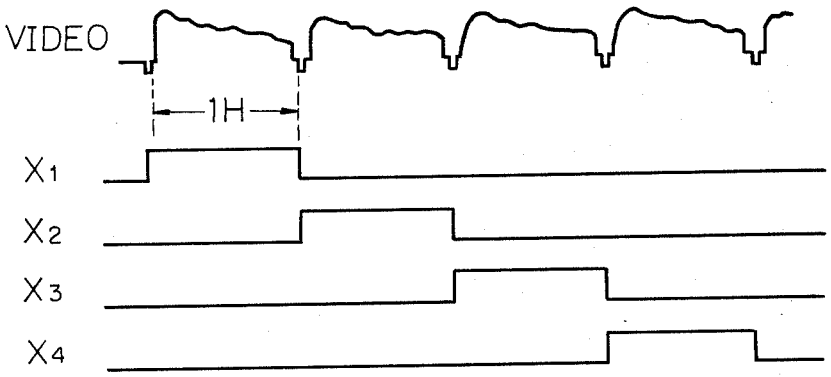
FIG. 2 and FIG. 3 are waveform diagrams for illustrating the operation of the circuit of FIG. 1.

Numeral 4 denotes a control circuit for producing various signals necessary for the operation of the display. Numeral 6 denotes a row electrode drive circuit which successively produces row selection signal pulses on output lines X1, X2, . . . X240, to be applied through buffer amplifiers to the corresponding row electrodes X'1, X'2, . . . with the pulse width of each row selection pulse being equal to one horizontal scanning interval, designated in the following as 1H, of the video signal. FIG. 2 is a timing diagram to illustrate the relationships between the row selection signal pulses and the video signal. These pulses sequentially select the row electrodes X'1, X'2, . . . ,X'240 during each successive 1H interval. When a row electrode is thus selected, then all of the 208 transistors coupled to that row electrode are set in the conducting state.

Figure 3:
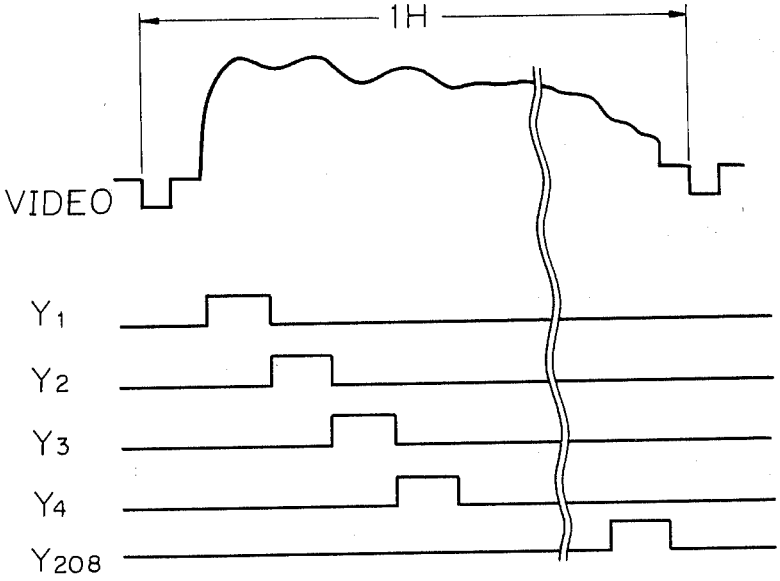

Numeral 8 denotes a column electrode drive circuit, and numeral 10 denotes a clock control circuit for controlling the supply of clock pulses to drive circuit 8 in order to reduce the power consumption thereof, as described in the following. As shown in the corresponding timing diagram of FIG. 3, column electrode drive circuit 8 produces a succession of selection signal pulses appearing on output lines Y1, Y2, . . . Y208 thereof during each horizontal scanning interval, each having a pulse width which is substantially equal to 1/208 times the horizontal scanning interval 1H. Each of these selection signal pulses, applied through a buffer amplifier, acts to select (i.e. set in the conducting state) a corresponding one of a set of switching transistors 12, 14, . . . 16, and hence to transfer the video signal to the corresponding one of column electrodes Y'1, Y'2, . . . for the duration of that selection signal pulse, since one of the channel electrodes of each of transistors 12,14, . . . is coupled to receive the video signal and the other channel electrodes is coupled to a corresponding column electrode. In this way, video signal voltages are stored in picture element capacitors C, at positions designated in matrix manner by the row electrodes and column electrodes. Thus, after completion of selection of all of the row electrodes, i.e. upon completion of one vertical scanning interval, video signal voltages are stored in all of the picture element capacitors C in the correct picture element positions to form an image represented by the video signal content.

The points of connection of transistors TR and capacitors C of display section 2 each constitute a picture element electrode. Liquid crystal is sandwiched between a first substrate, e.g. glass plate, on which the control circuit 4 shown in FIG. 1 (except for a part thereof) is formed as an integrated circuit, and a second substrate on which a common electrode is formed. Images such as television images etc can thereby be displayed in accordance with the voltages applied to the picture elements.

Figure 4:
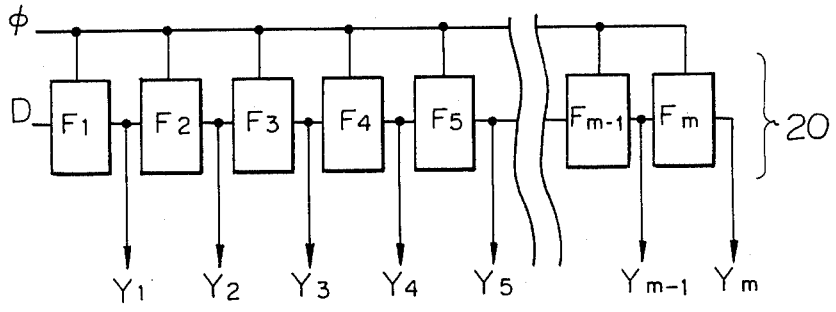
Fig. 4 PRIOR ART
FIG. 4 is a circuit diagram of a prior art type of electrode drive circuit for a matrix display device, which does not employ a clock control circuit.
Figure 5:
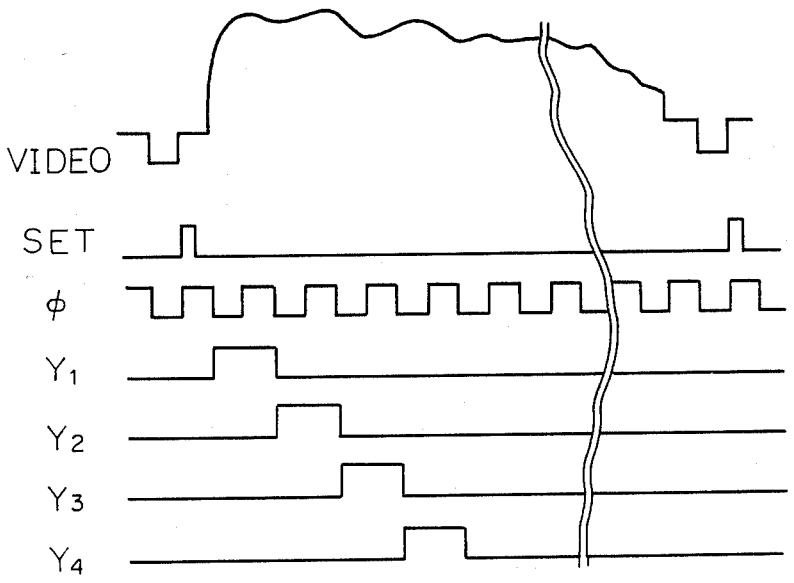
FIG. 5 is a waveform diagram for illustrating the operation of the circuit of FIG. 4.

The present invention is directed towards clock control circuit 10 and column electrode drive circuit 8 shown in FIG. 1. FIG. 4 shows an example of a prior art type of column electrode drive circuit in which no clock control circuit is used. Here, a set of series-connected shift register stages 20 constitute the column electrode drive circuit, with a clock signal $\phi$ being continuously applied to shift register 20. In this case, it is necessary to provide 208 shift register stages in order to sequentially select 208 column electrodes, while each selection signal pulse must have a peak voltage of the order of 15 V. Since it is necessary for the clock signal to have a frequency of the order of 4 MHz, a substantial level of power is consumed to charge and discharge the input capacitances of the shift register stages.

Figure 6:
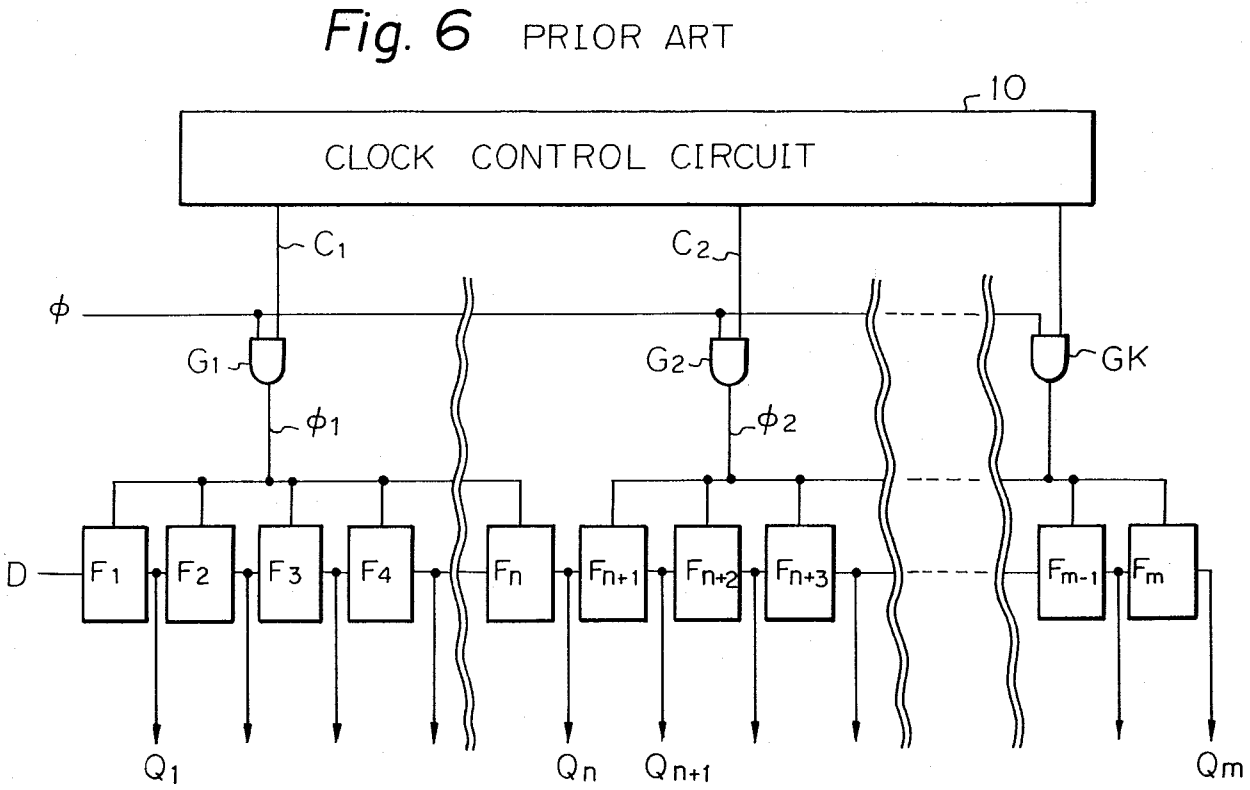
Fig. 6 PRIOR ART
FIG. 6 is a circuit diagram of an embodiment of a column electrode drive circuit according to the prior art, incorporating a clock control circuit.

A method of overcoming this problem has been proposed in Japanese Patent Laid-Open Publication No. 56-4184. According to this proposal, as illustrated in FIG. 6, the shift register stages constituting the column electrode drive circuit are divided into a plurality of groups, i.e. into K groups such as group F1 to Fn, with AND gates G1, G2, . . . Gk being respectively disposed to control the supply of the clock signal to respective groups of shift register stages. A clock control circuit 10 supplies control signal pulses to these AND gates G1, G2, . . . Gk, to thereby control the supply of the clock signal to successive groups of shift register stages.

Thus, following the start of each horizontal scanning interval, the clock signal will be supplied only to the first set of shift register stages, F1 to Fn, so that initially a series of column electrode selection pulses Q1,Q2, . . . Qn will be sequentially output to successively select the corresponding column electrodes. This selective supply of clock signal is achieved by the action of control signal C1 upon AND gate G1. Application of the clock signal to the other shift register stages is inhibited at this time. Subsequently, the supply of clock signal to the first set of shift register stages is inhibited, and control signal C2 acting on gate G2 causes the clock signal to be supplied only to the second set of shift register stages, i.e. $F_{n+1}$,, . . . In this way, by reducing the number of shift register stages in operation at a time, the power consumption of the column electrode drive circuit will be reduced by a factor of approximately 1/K.

Figure 7:
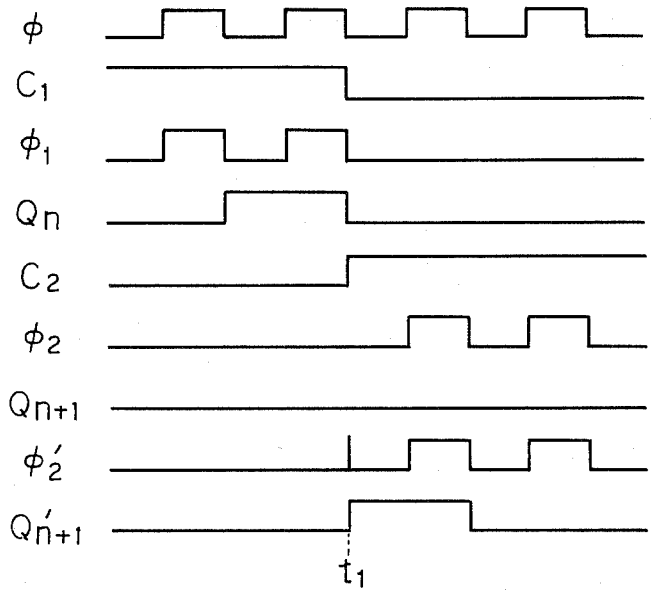
FIG. 7 is a waveform diagram for illustrating the operation of the circuit of FIG. 6.

However this method has the following disadvantages. Firstly, the operation is not stable. This problem will be described with reference to FIG. 7. It will be assumed that the selection signal pulse Qn from the final stage Fn of the first group of shift register stages is to result in initiation of a succeeding selection signal pulse from the first stage $F_{n+1}$ (i.e. is in effect to be transferred as a selection signal to the next stage, $F_{n+1}$) at a time $t_1$ That is to say, prior to time $t_1$, the first group of shift register stages is to be selected to receive the clock signal, while after $t_1$ the second group of shift register stages is to be selected. The corresponding control signal pulses produced from clock control circuit 10 are C1 and C2 shown in FIG. 7, and the corresponding clock signals supplied to the first and second groups of shift registers are designated as $\phi 1$ and $\phi 2$ respectively. However, as will be clear from FIG. 7, signal $\phi 2$ does not undergo a level transition which results in data write-in of the selection signal pulse Qn to shift register stage $F_{n+1}$ at time $t_1$.

In this case, therefore, no column electrode selection pulse will be output from stage $F_{n+1}$. In order to achieve a transfer of the selection signal from stage $F_n$ to stage $F_{n+1}$ at this time, it is necessary for the control signal pulses C1 and C2 to overlap during time $t_1$. However if this is done, then a spike pulse of the form indicated in waveform $\phi 2'$ will be produced at time $t_1$, and applied as a clock signal pulse to the second group of shift register stages $F_{n+1}$, $F_{n+2}$, . . . This may result in a selection signal pulse of the form $Q'_{n+1}$ being produced, but such pulses will not be produced in a stable and reliable manner. Thus data transfer between the groups of shift register stages will be extremely unstable.

A second problem which arises with such a prior art control circuit of the type shown in FIG. 6 is that such a circuit is not applicable to the use of dynamic shift registers to form a column electrode drive circuit. If the column electrode and row electrode drive circuits are formed directly upon a display panel substrate, in integrated circuit form, then the question of obtaining a satisfactory manufacturing yield becomes extremely important. For this reason, it is desirable to use dynamic shift registers for these drive circuits, since this type of shift register requires a minimum number of circuit elements, and hence provides a higher level of yield than is attainable if static type flip-flop shift registers are used for these circuits. However as is well known, the stages of such a dynamic shift register have only a limited memory duration, i.e. data holding time. If the clock signal is supplied only to one group of shift registers at a time, i.e. a currently selected group, then in the case of a display panel used for television images, since the duration of a horizontal scanning interval 1H is approximately 60 microseconds, it is necessary for the shift register stages to have a data memory duration of at least 60 microseconds. In actual practice, taking into consideration the operating conditions of such a display panel, problems will arise in ensuring stable operation unless a memory duration substantially longer than 60 microseconds can be achieved.

Figure 8:
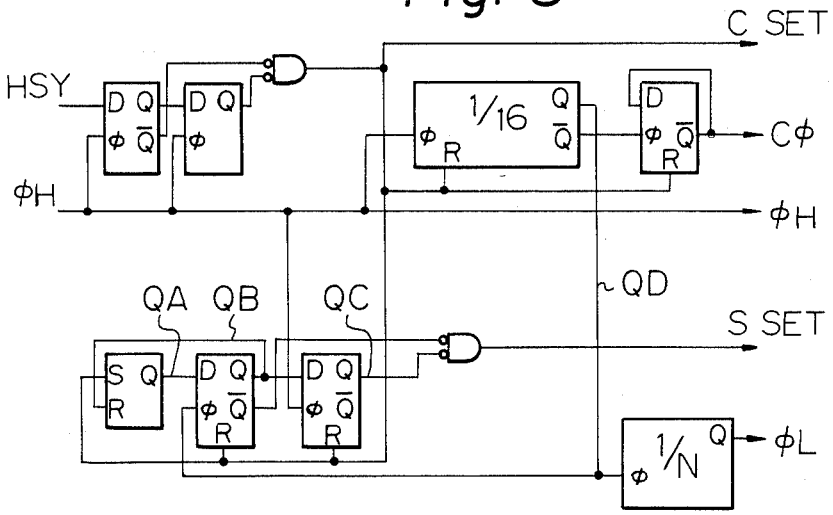
FIGS. 8 and 9 are circuit diagrams of a first embodiment of a drive circuit according to the present invention.

The present invention will now be described with reference to specific embodiments. FIG. 8 is a circuit diagram of a control signal generating circuit for a clock control circuit and column electrode drive circuit, which includes the control circuit 4 shown in FIG. 1. In FIG. 8, HSY denotes a horizontal sync signal derived from a television signal, $\phi_H$ denotes a first clock signal having a frequency of the order of 4 MHz, which is synchronized with signal HSY. As shown in the timing chart of FIG. 10, CSET denotes a signal for setting initial data into the clock control circuit as described hereinafter. This signal is output in synchronism with signal HSY. C$\phi$ denotes a shift register clock signal, having a period which is 1/32 times that of signal $\phi_H$. SSET denotes a signal for setting initial data into the column electrode drive circuit shift register, which is output after a suitable delay following the HSY signal. $\phi_L$ denotes a second clock signal, which has a frequency sufficiently lower than that of signal $\phi_H$ and sufficiently higher than that of signal HSY, being derived by frequency division of clock signal $\phi_H$ using a specific frequency division ratio.

Figure 9:
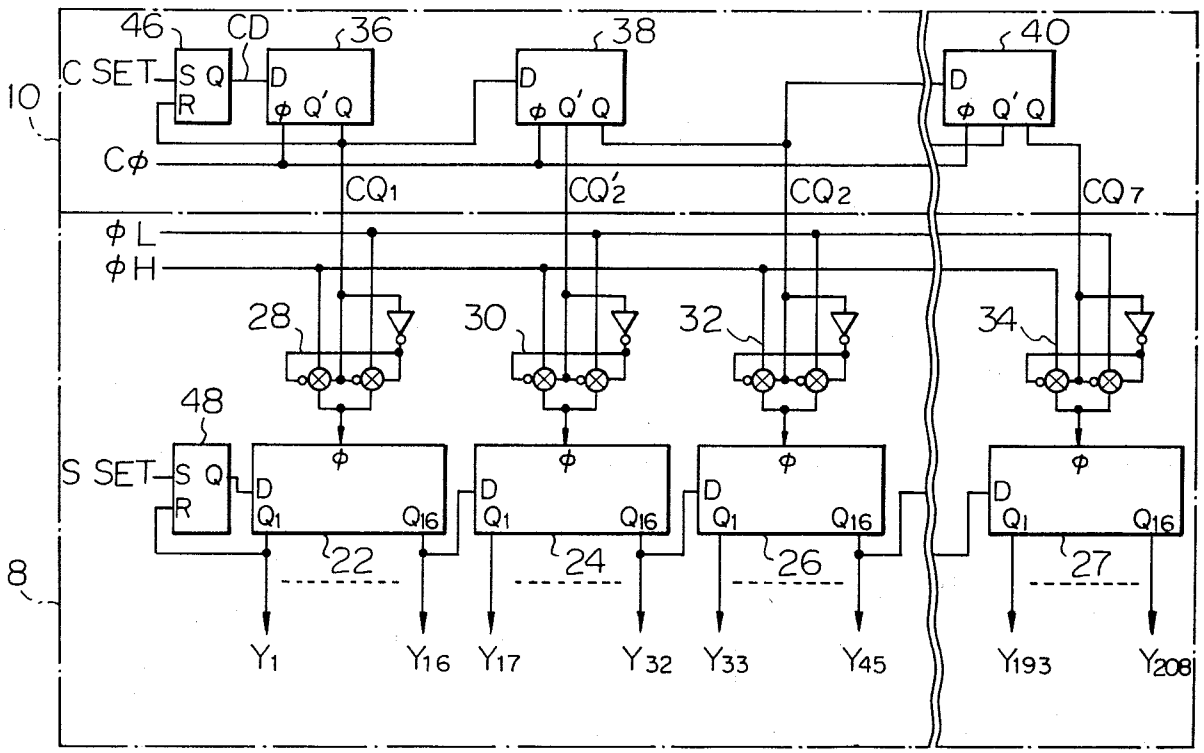
Figure 11:
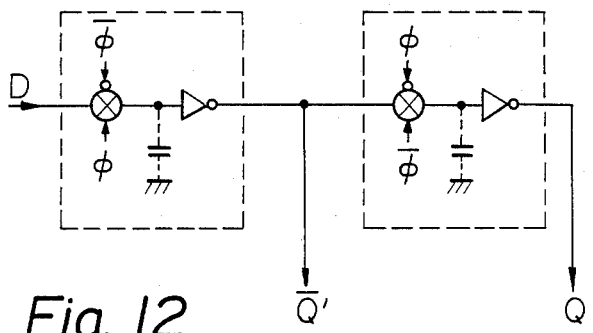
FIG. 11 is a circuit diagram of a dynamic shift register stage.

FIG. 9 shows a circuit diagram of an embodiment of a display drive circuit according to the present invention, which is controlled by signals produced from the control signal generating circuit of FIG. 8. Here, numeral 10 denotes a clock control circuit, made up of a set/reset flip-flop 46 and a set of seven static master/-slave flip-flops, 36, 38, . . . 40, connected in series as a shift register, driven by a clock signal C$\phi$ Numeral 8 denotes a column electrode drive circuit. Here, numerals 28, 30, . . . 34 denote a set of 13 selection circuits, which are controlled by control signals CQ1, CQ2, . . . output from clock control circuit 10 to selectively output either first clock signal $\phi$H or second clock signal $\phi$L. Numerals 22, 24, 26, . . . 27 respectively denote a set of 13 dynamic shift registers constituting a 208-stage shift register i.e. 13 groups of stages with each group comprising 16 stages, for producing column electrode selection signals on output lines Y1, . . . Y208. The supply of clock signals to each of the shift registers 22, 24, . . . 27 respectively is controlled by a corresponding one of selection circuits 28, 30, . . . 34. FIG. 11 shows a dynamic type of flip-flop circuit. Each of the dynamic shift registers 22, 24, 26, . . . 27 shown in FIG. 9 comprises 16 stages such as that shown in FIG. 11 connected in series.

Figure 12:
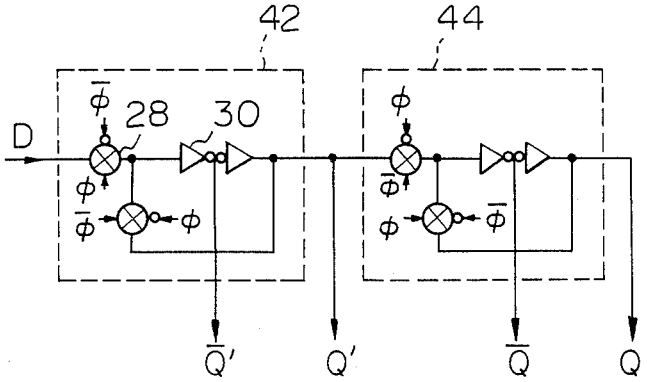
FIG. 12 is a circuit diagram of a static shift register stage.
Figure 13:
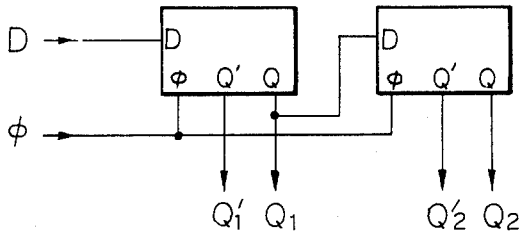
FIG. 13 is a circuit diagram of a two-stage shift register utilizing the static type stage shown in FIG. 12.
Figure 14:
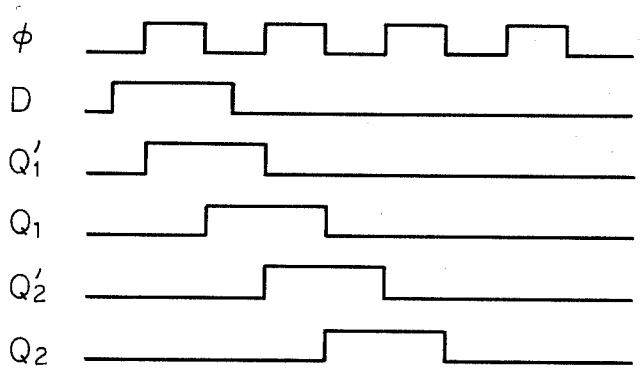
FIG. 14 is a timing diagram for illustrating the operation of the two-stage shift register of FIG. 13.

FIG. 12 shows a pair of series-connected latch circuits used to form clock control circuit 10 which are arranged to respectively execute latching of an input signal at the start of opposite phases of a clock signal $\phi$. Such a circuit is generally employed as a master-slave flip-flop, with only the second, i.e., slave latch output signal being utilized. With the present invention, output signals from both of the latch circuits are utilized, however, the term "master/slave" will be utilized in the present specification and claims for convenience in referring to such a pair of series-connected latch circuits. In FIG. 12, numeral 42 denotes a master section, and numeral 44 denotes a slave section of such a master-slave flip-flop. Q′ and $\overline{Q}$′ will be referred to hereinafter as master outputs, while Q and $\overline{Q}$ will be referred to as slave outputs. FIG. 14 shows the input and output signal waveforms for a two-stage shift register having the configuration shown in FIG. 13, formed of two of the series-connected pairs of latches shown in FIG. 12. As will be clear from the waveforms of FIG. 14, signals Q1′ and Q1, Q2′ and Q2 respectively mutually overlap by an amount equal to one half-period of clock signal $\phi$ In this way, by using both the master and slave outputs of such pairs of series-connected latches, overlapping output signals can be easily obtained. Such signals can be used as control signals CQ1, CQ2, . . . .from clock control circuit 10 shown in FIG. 9.

Figure 10:
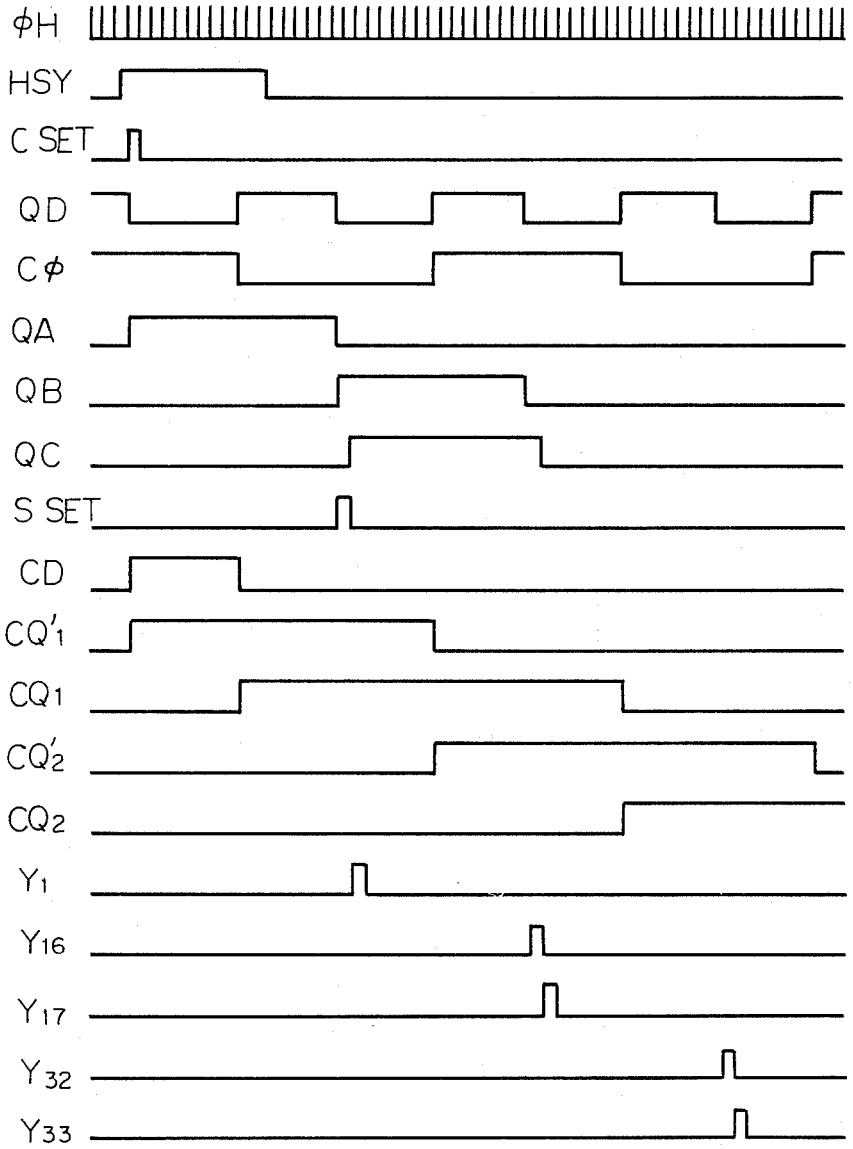
FIG. 10 is a waveform diagram for illustrating the operation of the circuits of FIG. 8 and 9.

The operation of the circuit of FIG. 9 will now be described in detail. When set/reset flip-flop 46 of clock control circuit 10 is set, by the CSET signal shown in FIG. 10, then the resultant H level output from flip-flop 46 is written into the initial stage flip-flop 36. When this occurs, the output signal from flip-flop 36 acts to reset flip-flop 46. Thus, after the CSET signal has been output, then on each falling edge of clock signal C$\phi$ output pulses at the high (H) logic level are successively produced from the shift register stages 36, 38, . . . 40. As shown in FIG. 10, the master outputs and slave outputs CQ′1, CQ1, CQ2′, CQ2 from shift register stages 36, 38, . . . 40 comprise a pulse train in which successive pulses mutually overlap by an amount equal to one half-period of clock signal C$\phi$. The first-stage slave output CQ1 controls selection circuit 28 of the first shift register group 22. The second-stage master output CQ′2 controls selection circuit 30 of the second shift register group 24. The seventh stage slave output CQ7 controls selection circuit 34 of the 13th shift register group 27.

As control signals CQ1, CQ2′, . . . CQ7 go to the H level, selection circuits 28, 30, . . . 34 respectively supply signal $\phi$H to the corresponding shift register groups. Conversely, these selection circuits supply signal $\phi$L to corresponding shift register groups when selection control signals CQ1, CQ′2, . . . CQ7 go to the L level. When set/reset flip-flop 48 is set by signal SSET, then initial data is input to the first shift register group 22 in the same was as set-reset flip-flop 46 applies initial data within clock control circuit 10, as described above.

As will be clear from FIG. 10, when the SSET signal goes to the H level, then since signal CQ1 has already gone to the H level, selection data is transferred to first shift register 22 by clock signal $\phi_H$. When the selection data has been transferred to the final stage of first shift register 22, then when signal Y16 has gone to the H level, since both CQ1 and CQ'2 are at the H level, clock signal $\phi_H$ will be applied simultaneously to both the first shift register 22 and second shift register 24. In this way, selection data is reliably transferred from the first shift register 22 to the second shift register 24. In the same way, selection data is transferred reliably between the remaining shift registers 24, 26, . . . 27 by the action of clock signal $\phi_H$. The shift registers which are not currently being supplied with first clock signal $\phi_H$ are supplied with second clock signal $\phi_L$, as a low-frequency refresh signal. This ensures a sufficiently long data holding time for these shift registers. The selection pulses output on lines Y1, Y2, . . . Y208 from shift registers 22, 24, . . . 27 control the switching transistors 12,14, . . . 16 shown in FIG. 1.

In this embodiment the column electrode drive circuit is divided into 13 sets of shift register stages. However in general, the circuit configuration can comprise any suitable number, i.e. n groups of stages, where n is selected based on considerations of power consumption and circuit arrangement.

Furthermore with this embodiment, dynamic shift registers are used to form the column electrode drive circuit, so that clock signal $\phi_L$ is used as a second signal. However if static-type shift registers are used to form the column electrode drive circuit, then the second signal be a fixed potential, i.e. the H level or the L level.

Figure 16:
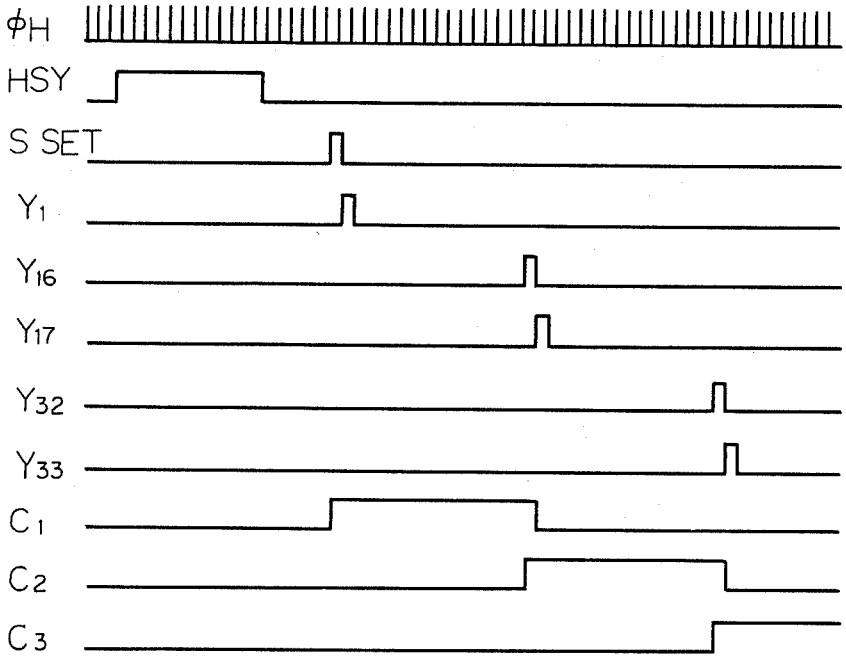
FIG. 16 is a timing diagram for illustrating the operation of the embodiment of FIG. 15.
Figure 15:
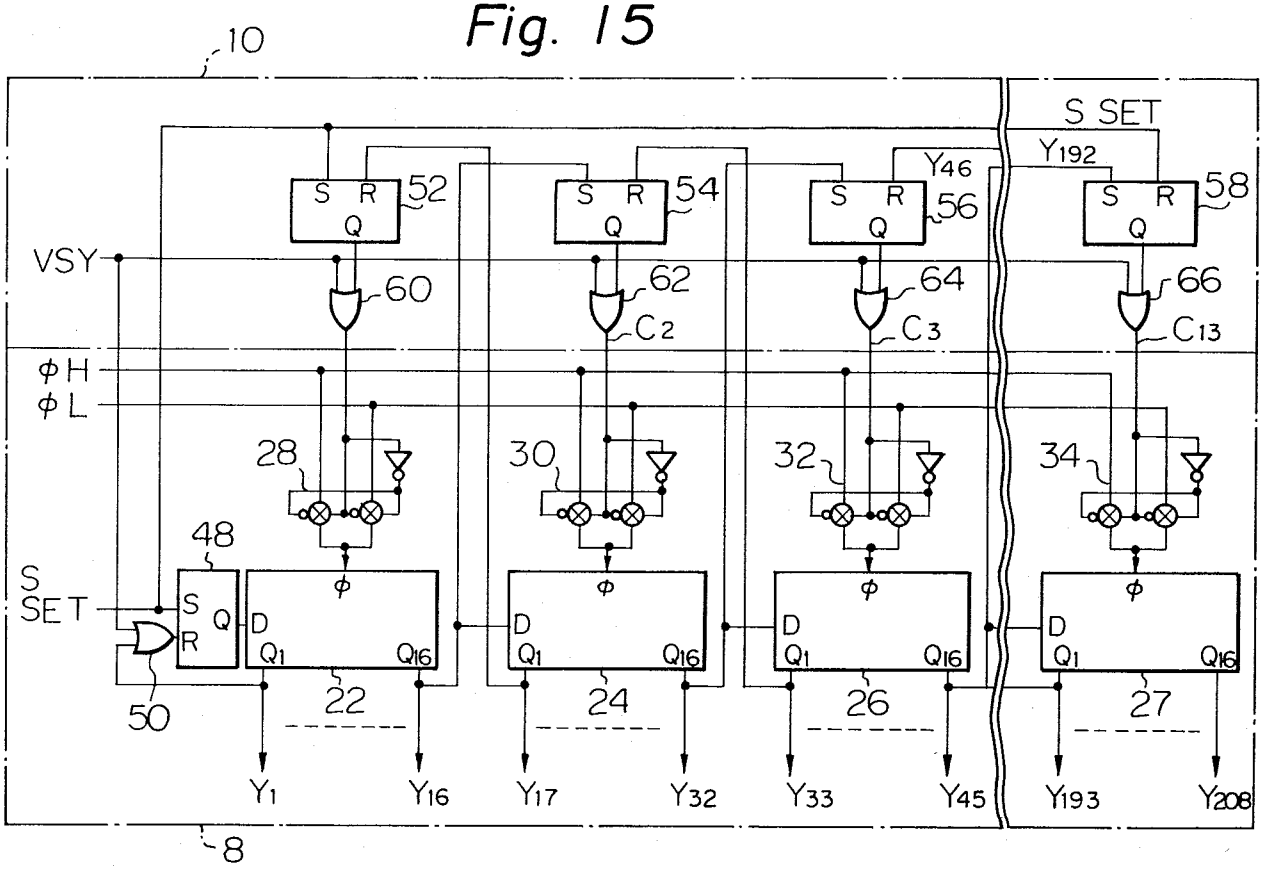
FIG. 15 is a circuit diagram of a second embodiment of a drive circuit according to the present invention.

FIG. 15 shows another embodiment of the present invention, and FIG. 16 is a timing chart for the circuit of FIG. 15. In FIG. 15, numeral 8 denotes a column electrode drive circuit, numeral 10 denotes a clock control circuit. The column electrode drive circuit 8 has a similar configuration to that of FIG. 9, other than for the provision of an OR gate 50. The clock control circuit 10 comprises 13 set/reset flip-flops 52, 54,56, . . . 58, and OR gates 60, 62, 64, . . . 66, provided for corresponding shift registers of column electrode drive circuit 8. The outputs from flip-flops 52,54, 56 . . . 58 are transferred through OR gates 60, 62, 64, . . . .64 to be respectively input to selection gates 28, 30, . . . 34. The set/reset flip-flop of the first shift register is set by the SSET signal, in the same way as for the embodiment of FIG. 8, and is reset by output Y17 from the initial stage of the second shift register 24. Set/reset flip-flop 58 of the 13th shift register is set by the final stage output Y192 from the 12th shift register (not shown in the drawing). Set/reset flip-flops 54, 56, . . . are used in common for the second to the 12th shift registers, and are each respectively set by the final stage output from the preceding shift register and reset by the initial stage output from the succeeding shift register.

Signal VSY is obtained by separation from the vertical sync signal of the television signal, and goes to the H level during each vertical flyback interval. This signal performs initial resetting of shift registers 22, 24, 26, . . . 27.

That is to say, when signal VSY goes to the H level, then set/rest flip-flop 48 is reset, whereby the data input of shift register 22 is fixed at the L level, and the outputs of OR gates 60, 62, 64, . . . 65 go to the H level. As a result, clock signal $\phi_H$ is applied to shift registers 22, 24, . . . 27, whereby when signal VSY returns to the L level, all of the outputs of shift registers 22, 24,26 . . . 27 go to the L level. If the period of signal $\phi_L$ is selected to be less than 1/208 times the vertical sweep interval, then performing initial setting by means of signal $\phi_L$ is advantageous with regard to reducing the power consumption.

After signal VSY has returned to the L level, set/reset flip-flops 48 and 52 become set when signal SSET is generated. As a result, the data input of the initial stage of shift register 22 goes to the H level, and clock signal $\phi_H$ is applied thereto. Thereafter, in the same way as for the circuit of FIG. 9, the selection signal is transferred within shift register 22, in response to clock signal $\phi_H$, and when the final stage output Y16 goes to the H level, then set/reset flip-flop 54 becomes set, and as a result signal $\phi_H$ becomes applied as the clock signal to the second shift register 24.

In this way, clock signal $\phi_H$ is supplied to the first and second shift registers simultaneously during the timing at which the selection signal is to be transferred from Y16 to Y17, so that reliable data transfer between the shift registers is achieved. When the selection data has been transferred to the second shift register 24, then as a result of set/reset flip-flop 52 being reset, the low-frequency clock signal $\phi_L$ is applied as a refresh signal to the first shift register 22.

In a similar way, the selection signal is reliably transferred to the other shift registers, with those shift registers which are not currently selected being supplied with the low-frequency clock signal $\phi_L$ as a refresh signal.

In the embodiment of FIG. 15, each set/reset flip-flop of clock control circuit 10 is set by the output signal from the final stage of the preceding shift register, and is reset by the output signal from the initial stage of the succeeding shift register. However it is also possible to ensure even greater reliability of operation by performing setting of each of these flip-flops by the output from a stage prior to the final stage of the preceding shift register and to perform resetting by the output signal from a second or subsequent stage of the succeeding shift register. In this way, the time for which clock signal $\phi_H$ is applied simultaneously to mutually adjacent shift registers will be increased.

In general, in order to ensure reliable transfer of the selection signal between the shift registers, it is necessary to ensure that the clock signal is applied simultaneously to mutually adjacent shift registers for a time equal to one half-period of that clock signal, or longer.

With the present invention, since at any specific point in time, the majority of the shift register stages are being supplied with a clock signal of low frequency, power consumption is minimized, while data transfer is reliably performed. In addition, it becomes possible to utilize dynamic shift registers, so that increased manufacturing yield can be attained.

Although the present invention has been described in the above with reference to a specific embodiment, it should be noted that various changes and modifications to the embodiment may be envisaged, which fall within the scope claimed for the invention as set out in the appended claims. The above specification should therefore be interpreted in a descriptive and not in a limiting sense.

What is claimed is:

1. A drive circuit for a matrix display device, comprising:

means for providing a clock signal and a second signal;

a control circuit responsive to said clock signal for producing a plurality of sequentially occuring control pulses of fixed duration with adjacent pulses timewise overlapping;

a plurality of successive selection circuits each having an output terminal and inputs coupled to receive said clock signal, said second signal and a separate successive control pulse, each selection circuit being responsive to the reception of a control pulse for applying the clock signal to the respective output terminal and responsive to the absence of the respective control pulse to apply the second signal to the respective output terminal;

whereby said clock signal appears at the output terminals of successive selection circuits during successive time intervals of fixed duration and said second signal appears at the output terminal of all of said selection circuits to which the respective control pulse is not currently supplied;

a plurality of cascade connected electrode drive shift register circuits for producing sequential electrode selection signal pulses, each said shift register circuit comprising a plurality of series connected shift register stages for producing a separate group of said sequential signal pulses, successive shift register circuits having clock input terminals connected to the output terminal of separate successive selection circuits, and means connecting the last stage of each shift register circuit to the input of the first stage of the next successive shift register circuit; and means providing an input pulse and applying said input pulse to the first of said shift register circuits whereby said input pulse is successively transferred between the stages of said shift register circuits and between the last stage of each shift register circuit and the input of the next successive shift register circuit;

said control pulses having durations whereby the overlap between adjacent control pulses occurs during the transition of supplying said input pulse to the last stage of one of said shift register circuits and supplying said input pulse to the input of the succeeding shift register circuit whereby said clock signal is supplied simultaneously to both of said shift register circuits groups during a time interval of duration at least equal to one half period of clock signal.

2. The drive circuit of claim 1, in which said shift register stages are dynamic shift register stages, and in which said second signal is a second clock signal have a frequency substantially lower than the frequency of the first mentioned clock signal.

3. The drive circuit of claim 1, in which said clock signal control circuit comprises a plurality of static master slave flip flops connected in series to form a shift register, successive control pulses being produced by successive master and slave outputs of said series connected master slave flip-flops.

* * * * *